PLEATABLE CURTAIN

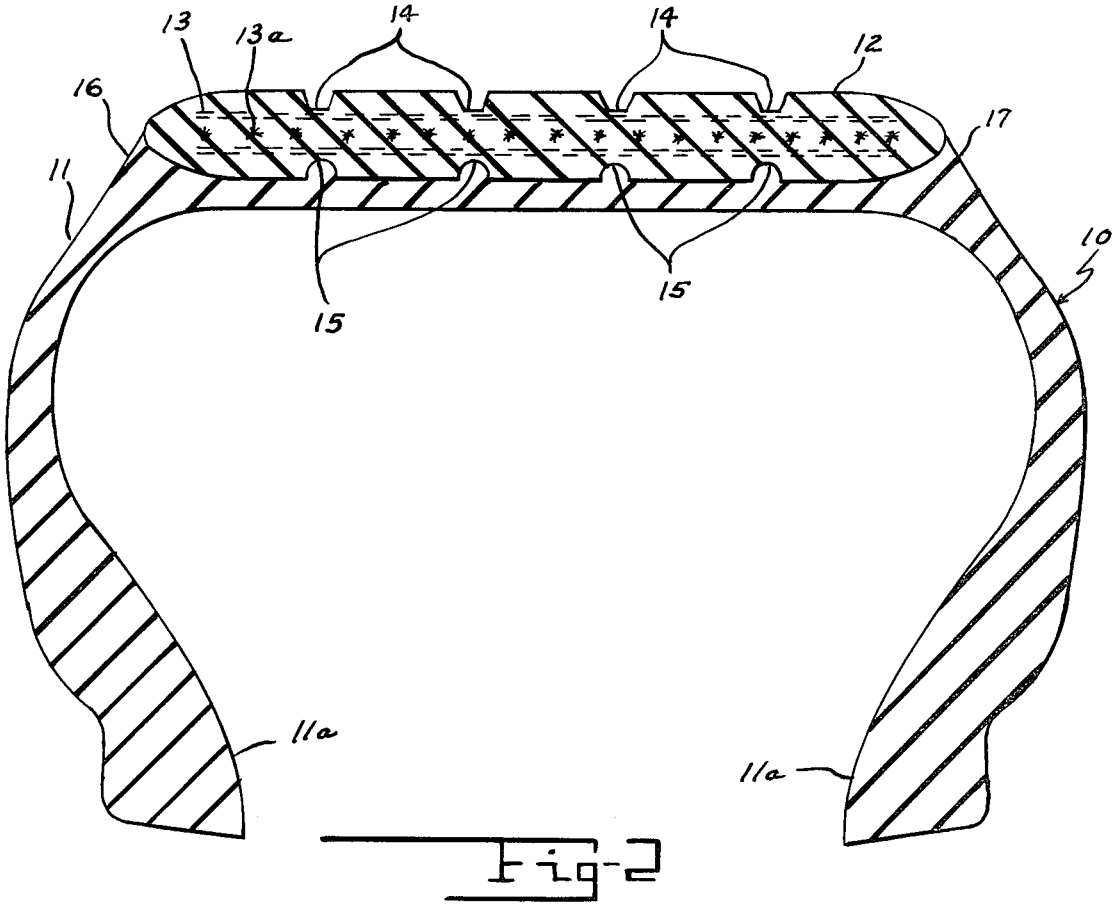
Fig-2
Fig-5
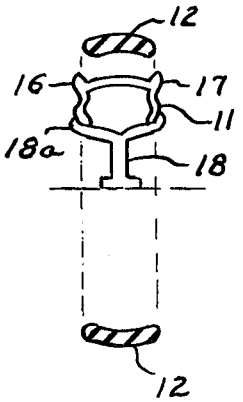
Fig-4a
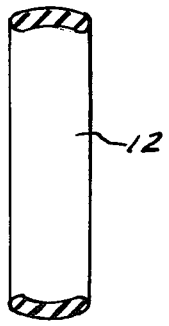
Fig-6
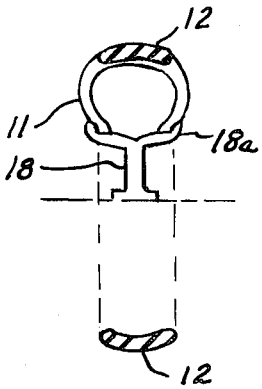

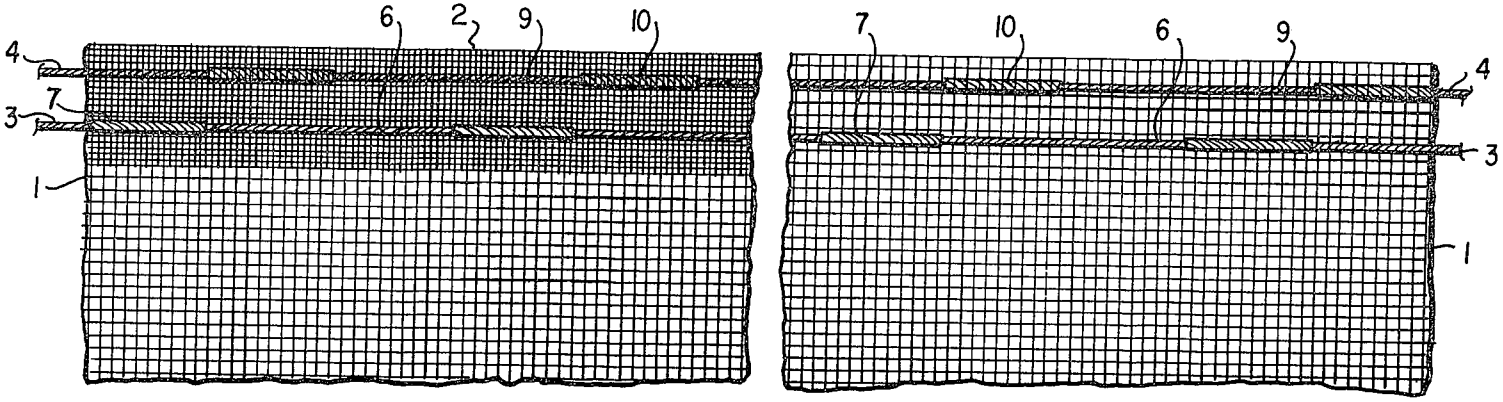
FIG. 1a
FIG. 1b
1
2
3
4
6
7
9
10
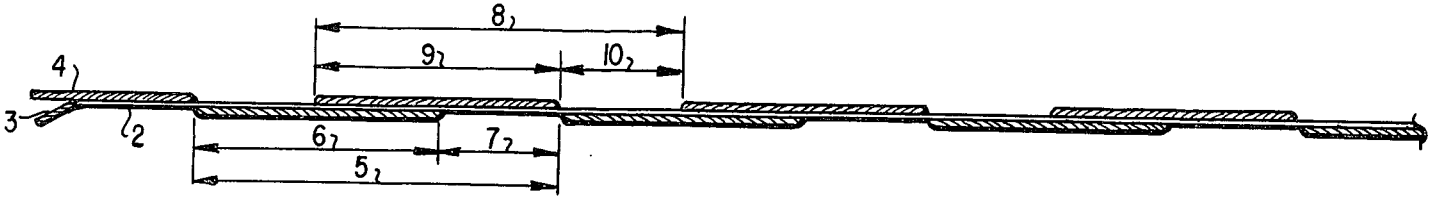
FIG. 2
2
3
4
5
6
7
8
9
10
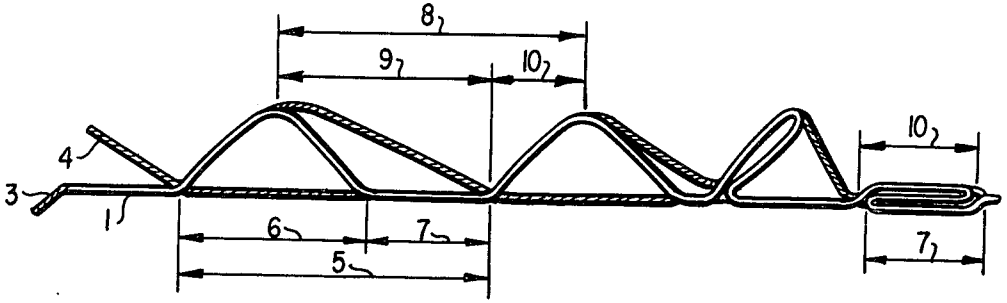
FIG. 3
1
3
4
5
6
7
8
9
10

BACKGROUND OF THE INVENTION

The present invention concern curtains or drapes with hanger means worked thereinto during their manufacture, such as loops, straps, holes, and further being provided with gathering or pleater means, such as partially flowing and partially longitudinally adjustable pull cords or the like, which are worked continuously into said drapes or curtains.

Gathering pleats are produced in one of the prior art curtains, such as, for example, the curtains as disclosed in the German Pat. No. 1,139,251, wherein two pull cords are worked into the upper edge of the curtains running alternately; with short distances on the front side, and on the back side of the curtain, or the pull cords may be worked into a woven or knitted piping to be longitudinally displacable.

Known in the prior art are also curtains or drapes of a type wherein pull cords are worked into one side of the curtains and are alternately arranged by means of multiple directions of flow, and by means of points of attachment to form a consecutive line of two or more pleats which stand away from the curtain and are gathered in a bundle of pleats.

Additionally, there are known in the prior art curtains which are not provided with pull cords, and wherein the upper end of said curtains is mechanically placed into pleats, which pleats lie flatly to the curtain and over which is stitched a carrying tape, and is then placed on the commercial market. These types of pleats offer a special decorative effect which is currently in widespread use. On the other hand, in addition to high manufacturing costs of curtains with such type of pleats, which are permanently fixed by means of a pleater-tape, have the disadvantage that the ready-made curtains cannot be cleaned as thoroughly and easily as an unfolded curtain.

OBJECT AND SUMMARY OF THE INVENTION

It is therefore the object of the present invention to produce a curtain with worked-in pull cords, in such a manner so that the curtain is placed in close or spaced-apart single or double or even multi-pleats, wherein the ends of the pleats are pulled together and are releasably fixed by means of the pull cords on the curtain.

The problem is solved whereby one or a plurality of pull cords at one side, and one or a plurality of pull cords on the other side of the curtain, are arranged at equal or at varying distances from the upper edge of the curtain.

For the purpose of obtaining a single pleats according to the instant invention, an embodiment comprises one or a plurality of pull cords arranged on one side of the curtain extending floatingly over two thirds of the length of a pull cord repeat pattern and run in bound arrangement over the remaining one third in an adjustable manner in the train of the curtain; and one or a plurality of pull cords on the other side of the curtain runs in the identical repeat, alternatingly by half the length of a single pleat in opposition to the pull cords of the opposite side of the curtain.

The forming of double pleats, in which the pleats are formed by means of the pull cords on one side of the curtain, and is pulled towards the curtain on the other side, is inventively obtained in that one or a plurality of pull cords on one side of the curtain are adjustably tied to the curtain at the beginning and the end of a pull cord series over a distance equal to one sixth of the length of the repeat or periodicity, and run therebetween over four-sixths of the length of the repeat in a floating or loose manner, whereby the pull cords are adjustably tied to the curtain in the center of the loose repeat stretch, and that one or a plurality of pull cords on the other side of the curtain are running in the same repeat, and are alternatly arranged by half the length of a repeat opposite the pull cords of the firstmentioned side of the curtain.

On the basis of this pull cord arrangement, pleats are developed at both sides of the curtain, which are in a continuous arrangement having no space between the same, whereby the ending of a pleat on one side of the curtain represents at the same time the beginning of an identical pleat on the other side of the curtain, so that the front and the back side of the curtain have the identical pleat design.

BRIEF DESCRIPTION OF THE DRAWINGS

Types of pleats, which result from the combinations of individual pleats with the double pleat, and further embodiments of the instant invention, are illustrated in detail in the drawings, wherein:

FIG. 1*a* and 1*b* show the upper edge portion of a curtain according to the instant invention;

FIG. 2 shows a top view of the same part of a curtain of FIG. 1;

FIG. 3 shows a top view of the part of a curtain of FIG. 1 in the individual phases of forming single pleats;

DETAILED DESCRIPTION OF PREFERRED EMBODIMENTS

Figure 4:
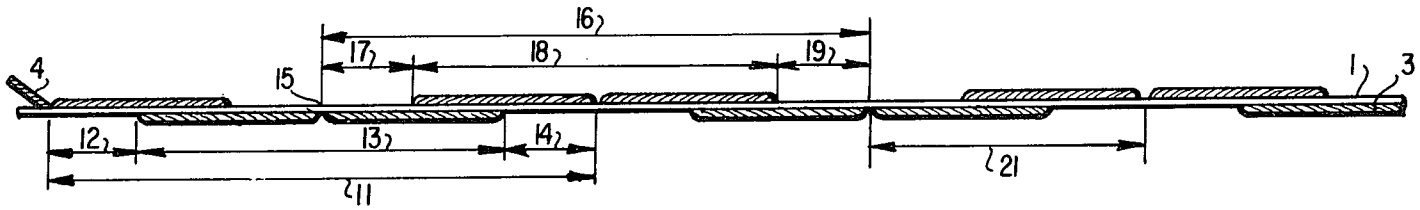
FIG. 4 shows a top view of a part of a curtain according to the instant invention with a pull cord arrangement for forming double-pleats.

The curtain 1 of FIG. 1*a* is provided with a tighter woven or knitted border 2 than that of the curtain shown in FIG. 1*b*, which provides a greater stability of the pull cord guidance and is therefore limited to a predetermined width of the border. In the embodiments of FIGS. 1*a* and 1*b*, a pull cord 3 is worked-in at the front side of the curtain 1, and an additional pull cord 4 is worked-in at the back side of the curtain, as is clearly seen from FIGS. 2 and 3. The pull cord 3 is arranged at a greater distance from the upper edge of the curtain than the pull cord 4. The arrangement may also be in the reverse, or the pull cord can be worked-in at an equal distance from the upper edge of the curtain, or the afore-mentioned arrangements may be made with more than one pull cord on each side of the curtain.

For forming single pleats which lie flatly on the curtain, as illustrated in FIGS. 1 to 3, the pull cord 3 floats or runs within a pull cord repeat pattern 5, from left to right, via a free portion 6, and continues adjustably thereafter through an enclosed portion 7 in a tubing or piping, or is tied into the curtain 1, whereby the free portion 6 corresponds with the length of a single pleat, and the enclosed portion 7 corresponds with half the length of a single pleat. The pull cord 4 which is worked into the other side of the curtain 1 runs within a pull cord repeat pattern 8 over a free portion 9 which is identical in length to the free portion 6 and continues through an enclosed portion 10 which is of the same length as the enclosed portion 7 and is displacably or adjustably tied into a tubing or in the curtain 1. As can be seen from FIG. 2, the pull cord repeat pattern 8, in view of the, or compared with the pull cord repeat pattern 5, is arranged alternately by half the length of a single pleat, namely, by the section 7 or 10.

If one operates the pull cords 3 and 4, i.e., if one slides the tied-down pull cord sections 7 and 10, for example, to the right, namely alternately one after the other, there results then the formation of curtain 1, as illustrated in FIG. 3 in single consecutive fold phases up to the final single pleat at the right side of FIG. 3. This pull cord arrangement produces single pleats which follow one another without any space therebetween. If it is intended to place single pleats in spacedapart arrangement, then the pull cords are arranged to be adjustable at both sides of the curtain section which follows each repeat pattern 5 and which is proposed as the space therebetween.

Figure 5:
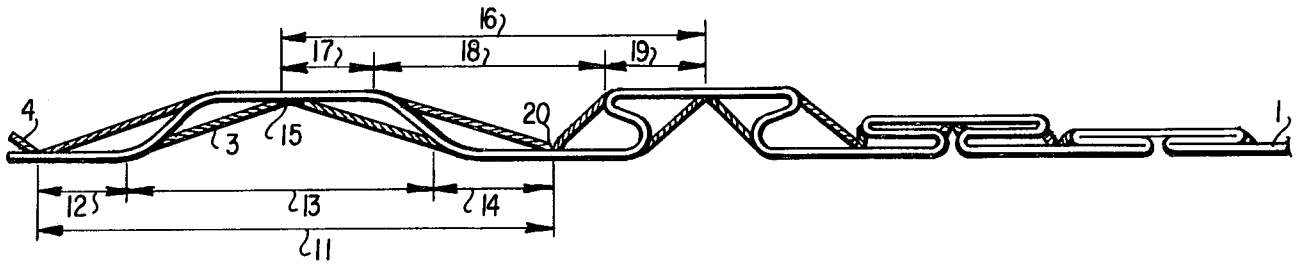
FIG. 5 shows the same part of a curtain in the individual phases of forming double-pleats.

FIGS. 4 and 5 illustrate top views of the curtain of the instant invention which, as shown in FIG. 5, is placed in double-pleats. The pull cord 3 is at first adjustably tied onto the curtain 1 at one side of the curtain and then follows a pull cord repeat pattern 11. The repeat pattern 11 comprises, from left to right, a first enclosed portion 12, a free portion 13 and a second enclosed portion 14. The pull cord 3 is movably attached to the curtain 1 at the center 15 of the free portion 13. The pull cord 4 on the opposite side of the curtain 1 is arranged within the pull cord arrangement 16 in the same manner as the pull cord 4, so that the first enclosed portion 17 corresponds with the first enclosed portion 12, the free portion 18 corresponds with the free portion 13, the center attached point 20 corresponds with center attached point 15, and second enclosed portion 19 corresponds with second enclosed portion 14. As may be seen from FIG. 4, the pull cord repeat pattern 11, compared with the pull cord repeat pattern 16, is alternately arranged by half the length of the sequence, namely, by the length 21.

FIG. 5 shows the individual phases of a double-pleat formation, which results from the arrangement of the pull cords according to FIG. 4 after operation of the pull cords. There result also here, as is the case in FIG. 3, pleats which are consecutively spaced without any space therebetween (right section of FIG. 5).

Figure 6:
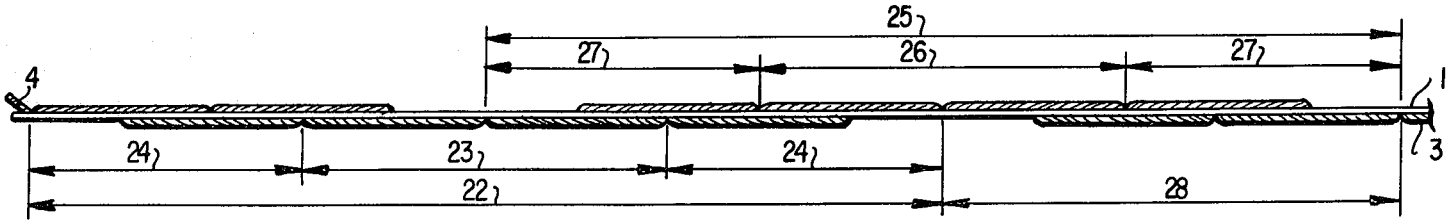
FIG. 6 shows a top view of a part of a curtain according to the instant invention with a pull cord arrangement for forming multi-pleats.
Figure 7:
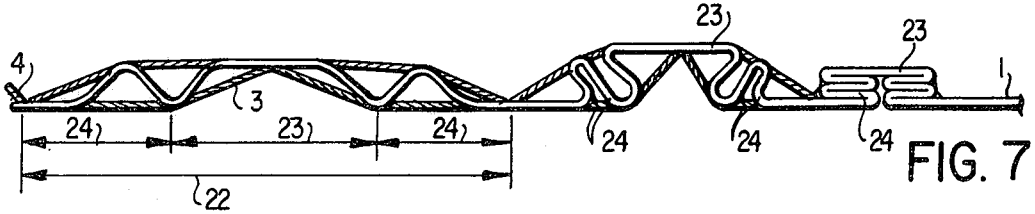
FIG. 7 shows the same part of a curtain in the individual phases of forming multi-pleats.

In FIGS. 6 and 7 are demonstrated the pull cord arrangements and formation of pleats which represent a combination of double and single pleats and which combination is here termed as multi-pleats. A multi-pleat arrangement, the length of which, for example, is indicated with 22, is formed by means of a double pleat repeat pattern 23, as already described in FIG. 4 as 13, and a respective single pleat repeat pattern 24 which is arranged immediately before and after the double pleat repeat pattern 23 together with the pull cord arrangement of a single pleat repeat pattern 25, which is worked into the other side of the curtain, wherein the double pleat repeat pattern 26 corresponds with the double pleat repeat pattern 23 and the single pleat repeat pattern 27 corresponds with the single pleat repeat pattern 24 in size and function, is alternately arranged by half the length of the pull cord arrangement, namely, by the length 28, compared with the pull cord arrangement 22. The individual phases of the pleat formation of the curtain according to FIG. 6 are again shown in FIG. 7.

Figure 9:
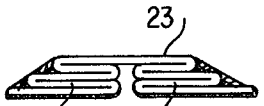
FIG. 9 shows a multi-pleat formation of the curtain of FIG. 8.
Figure 8:
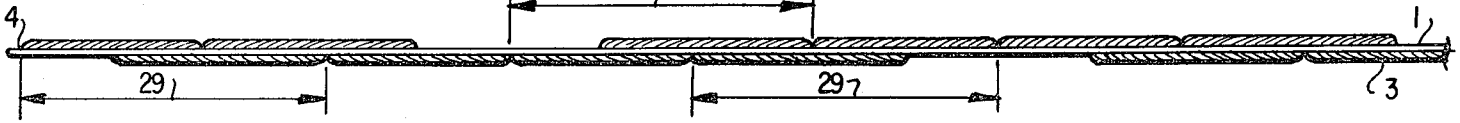
FIG. 8 shows a variation of the curtain according to FIG. 6.

FIG. 8 illustrates a variation of the inventive arrangement with regard to pull cord arrangement according to FIG. 6. In the curtain of FIG. 8, the single pleat repeat patterns 29, compared with the single pleat repeat patters 27 on the opposite side of the curtain, are measured longer than half of the double pleat repeat pattern 11 of FIG. 4, so that an aesthetically altered form of pleats results in the curtain, as shown in FIG. 9. The single pleat repeat patterns 29 may also be of a shorter measurement than half of a double-pleat arrangement. In this case, the double pleat repeat pattern 23 which is shown in FIG. 9 would cover the single pleats 29.

Of course, for the purpose of economizing on curtain material, a predetermined distance may be arranged between single, double and multi-pleats by means of straight, or flat curtainsections, in which the pull cords are tied-down at both sides of the curtain.

Figure 10:
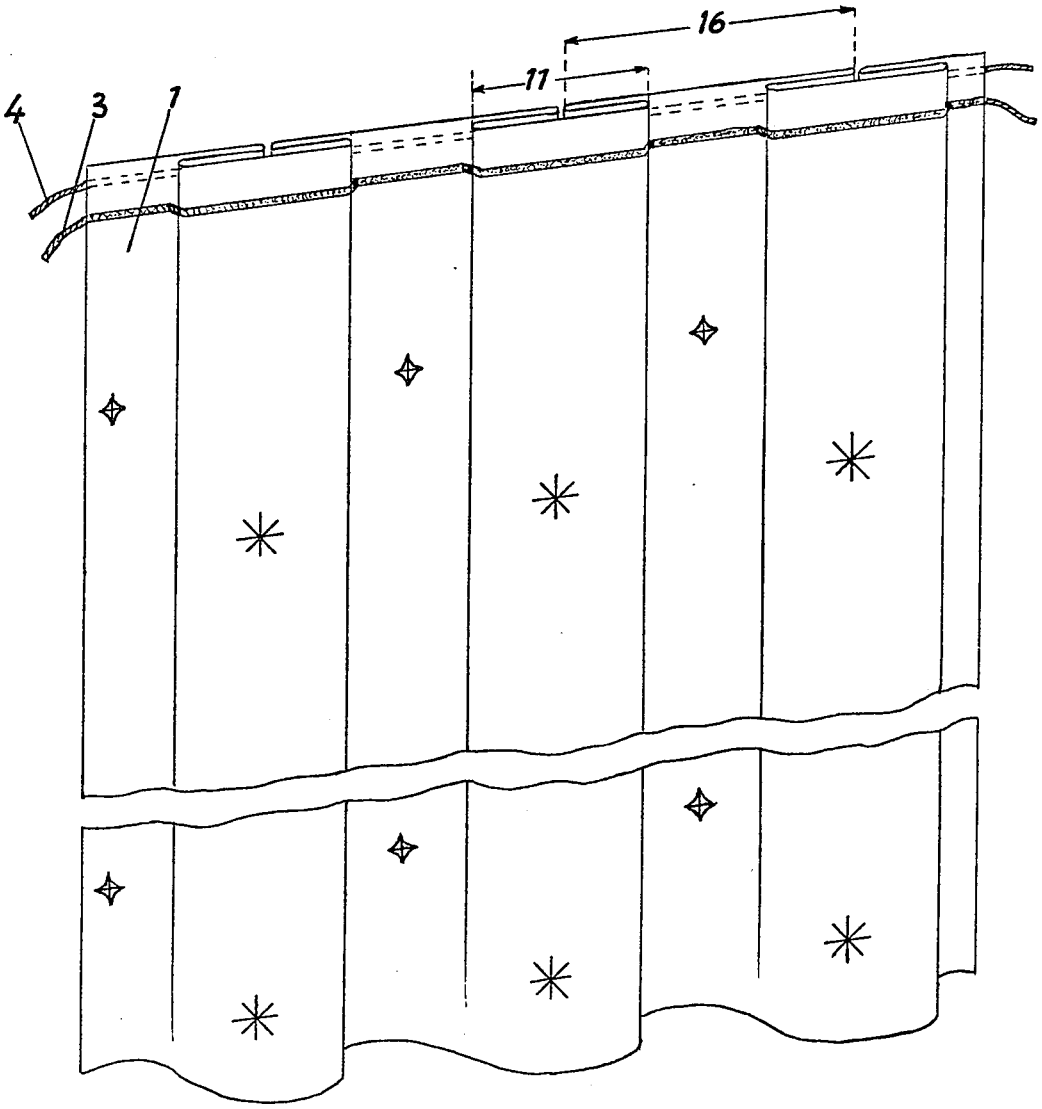
FIG. 10 shows a front view of a curtain with a design.

In curtains which have a design or have ornaments, general value is placed on arranging a matched-up series of the design with the intended pleats or groups of pleats so as to obtain a decorative effect which is as even in design as possible. For this purpose, it may be proposed that the pull cord sections 5, 11 and 22 are coordinated with each other with regard to their length with the sections of the design in the curtain fabric. A design arrangement with double pleats is seen in FIG. 10.

It should also be mentioned here that the hanger means which are required for fastening the curtain 1 by means of hangers on the curtain rail, such as straps or loops, or the like, have been left off in the drawing for the purpose of providing a clearer view. With regard to the possibility of utilization on the curtain, the hanger means, for example the hangers, may be worked into the section 7 or 10, in FIG. 5, within the section 12 and 14 or 17 and 19, and in FIG. 7 within the section 24 or 27.

What is claimed is:

1. A pleatable curtain comprising:

a curtain having a front side, a back side and an upper edge;

hanging means for hanging said curtain affixed at said upper edge; and pleating means for pleating said curtain, comprising at least one pull cord worked into said front side at a first fixed distance from said upper edge in a repeat pattern, said repeat pattern comprising a plurality of portions, wherein said pull cord is movably enclosed over at least one of said portions and is freely arranged over at least one other of said portions; and at least one further pull cord worked into said back side at a second fixed distance from said upper edge in a further pattern being identical with said repeat pattern and being transposed from said repeat pattern by one half the length of said repeat pattern, whereby when said pullcord and said further pull cord are operated said curtain is formed into a series of pleats.

2. The pleatable curtain according to claim 1, wherein said repeat pattern being a single pleat forming pattern comprising two portions, the first of said two portions being movably enclosed and comprising one third of the length of said single pleat forming pattern and the second of said two portions being freely movable and comprising two thirds of the length of said single pleat forming pattern.

3. The pleatable curtain according to claim 1, wherein said repeat pattern being a double pleat forming pattern comprising four portions, the first of said four portions being movably enclosed and comprising one sixth of the length of said double pleat forming pattern, the second of said four portions being freely movable and comprising one third of the length of said double pleat forming pattern, the third of said four portions being freely movable and comprising one third of the length of said double pleat forming pattern, the fourth of said four portions being movably enclosed and comprising one sixth of said double pleat forming pattern, said second portion and said third portion being separated by a point of attachment of said pull cord, said pull cord being movable through said point of attachment.

4. The pleatable curtain according to claim 1, wherein said repeat pattern comprises a multiple of two single pleat forming patterns each of which comprises two portions, the first of said two portions being movably enclosed and comprising one third of the length of said single pleat forming pattern and the second of said two portions being freely movable and comprising two thirds of the length of said single pleat forming pattern, and a double pleat forming pattern evenly dividing said multiple, comprising four portions, the first of said four portions being movably enclosed and comprising one sixth of the length of said double pleat forming pattern, the second of said four portions being freely movable and comprising one third of the length of said double pleat forming pattern, the third of said four portions being freely movable and comprising one third of the length of said double pleat forming pattern, the fourth of said four portions being movably enclosed and comprising one sixth of said double pleat forming pattern, said second portion and said third portion being separated by a point of attachment of said pull cord, said pull cord being movable through said point of attachment.

5. The pleatable curtain according to claim 4, wherein said multiple is one.

6. The pleatable curtain according to claim 4, wherein the length of each single pleat forming pattern is equal to one half of the length of said double pleat forming pattern.

7. The pleatable curtain according to claim 4, wherein the length of each single pleat forming pattern is longer than one half of the length of the double pleat forming pattern.

8. The pleatable curtain according to claim 1, wherein the length of said repeat pattern is coordinated with a design in said curtain.

9. The pleatable curtain according to claim 1, wherein said first fixed distance is equal to said second fixed distance.

10. The pleatable curtain according to claim 1, wherein said first fixed distance is different than said second fixed distance.

* * * * *